United States Patent [19]

Takahashi

[11] 4,278,112

[45] Jul. 14, 1981

[54] YARN FEEDER

[75] Inventor: Kihei Takahashi, Uozu, Japan

[73] Assignee: Yoshida Kogyo, K.K., Tokyo, Japan

[21] Appl. No.: 58,252

[22] Filed: Jul. 17, 1979

[30] Foreign Application Priority Data

Jul. 18, 1978 [JP] Japan ..... 53-87980

[51] Int. Cl.[3] ..... D03D 47/36

[52] U.S. Cl. ..... 139/452; 242/110.1; 66/132 R

[58] Field of Search ..... 139/450, 452; 242/47.01, 47.08, 47.09, 110, 110.1; 66/132 R

[56] References Cited

U.S. PATENT DOCUMENTS

| | | | |
|---|---|---|---|
| 3,224,467 | 12/1965 | Gagliardo | 139/452 |
| 3,243,975 | 4/1966 | Lawson et al. | 66/132 R |
| 3,674,057 | 7/1972 | Hosono et al. | 139/452 |
| 4,174,076 | 11/1979 | Tolliver | 242/110.1 |

*Primary Examiner*—Henry Jaudon

*Attorney, Agent, or Firm*—Robert E. Burns; Emmanuel J. Lobato; Bruce L. Adams

[57] ABSTRACT

A weft yarn feeder for use in a shuttleless loom has a pair of spaced circular plates and a spindle rotatably supported on the circular plates. The spindle has a pair of externally threaded portions of opposite thread directions. A pair of threaded carriages are carried on the externally threaded portions of the spindle. A plurality of angularly spaced links are pivotally connected to each of the carriages, and have end portions pivotally and loosely connected to a plurality of angularly spaced yarn bars, which have end portions slidably disposed in a plurality of radial guide slots in the circular plates. The yarn bars jointly provide a cylinder-like configuration around which a weft yarn is to be wound and the diameter of which can be varied by rotating the spindle to move the yarn bars radially outwardly and inwardly through the links and carriages.

13 Claims, 8 Drawing Figures

YARN FEEDER

BACKGROUND OF THE INVENTION

1. Field of the Invention

The present invention relates to a weft yarn feeder for use in shuttleless looms such as needle looms.

2. Prior Art

Known weft yarn feeders generally comprise a spool around which a weft yarn is wound and from which the weft yarn is fed or paid out at a constant rate to a filling carrier in response to the rotation of the spool in synchronism with operation of the filling carrier. There has been a need for a device incorporated in the weft yarn feeder for changing the rate of feed of the weft yarn so as to accommodate various yarn demands for different widths of fabric to be produced or so as to compensate for varying yarn stretchability due to different degrees of ambient temperature and humidity.

SUMMARY OF THE INVENTION

It is an object of the present invention to provide a yarn feeder having means for supplying a yarn at different rates of feed at a constant speed of rotation of the yarn feeder.

Another object of the present invention is to provide a yarn feeder having a link mechanism for continuously and smoothly changing the diameter of yarn winding means.

According to the present invention, a yarn feeder includes a spindle rotatably supported on a pair of spaced plates and having a pair of threaded portions of opposite thread directions. Each of the spaced plates has a plurality of substantially straight, radial guide slots angularly spaced from each other. A pair of threaded carriages engage the pair of threaded portions of the spindle, respectively, and are movable toward and away from each other in response to rotation of the spindle. A plurality of angularly spaced yarn bars are disposed around the spindle and have end portions slidably received in the guide slots.

The yarn bars are operatively connected to the carriages by a pair of link means pivotally connected to the yarn bars and the carriages. By turning a knob fixed to the spindle, the carriages are linearly moved on the spindle toward or away from each other, whereupon the link means cause the yarn bars to be displaced radially outwardly away from or inwardly toward the spindle, thereby changing the diameter of a cylindrical configuration defined jointly by the yarn bars and around which a weft yarn is to be wound.

BRIEF DESCRIPTION OF THE DRAWINGS

The above and other objects, features and advantages of the present invention will become apparent from the following description when taken in conjunction with the accompanying drawings, in which.

DESCRIPTION OF THE PREFERRED EMBODIMENT

Figure 1:
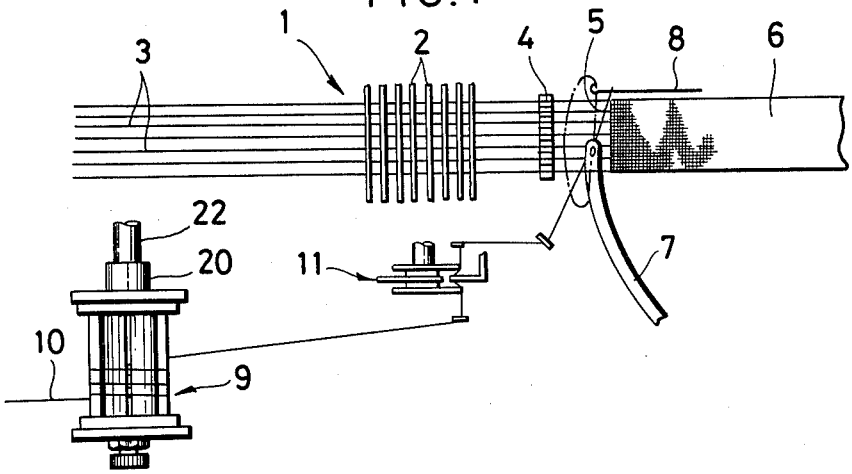
FIG. 1 is a schematic plan view of a needle loom in which a yarn feeder of the present invention is employed.

A weaving machine or loom 1 schematically illustrated in FIG. 1 generally comprises a plurality of heddles 2 for separating a plurality of warp threads 3 to form warp sheds successively, a beat-up reed 4 movable back and forth to beat up an inserted filling 5 against the fell of a narrow fabric 6 being produced, a filling carrier 7 pivotable to place a filling 5 across the warp shed, and a selvage-forming latch needle 8 reciprocable alongside of the fabric 6 for catching and knitting loops of fillings 5 with previous filling loops. The loom 1 also includes a weft yarn feeder 9 actuatable in synchronism with the operation of the filling carrier 7 for positively advancing a weft 10, and a tension compensator 11 disposed between the filling carrier 7 and the weft yarn feeder 9 for keeping the weft 10 under constant tension while the weft 10 is being supplied to the filling carrier 7.

Figure 2:
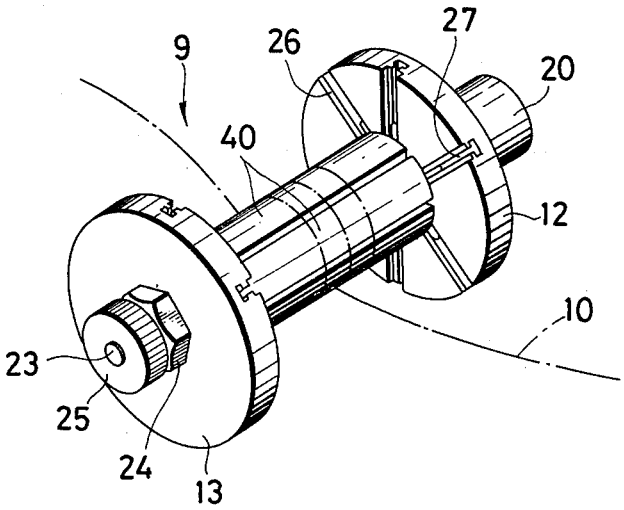
FIG. 2 is an enlarged perspective view of the yarn feeder.
Figure 3:
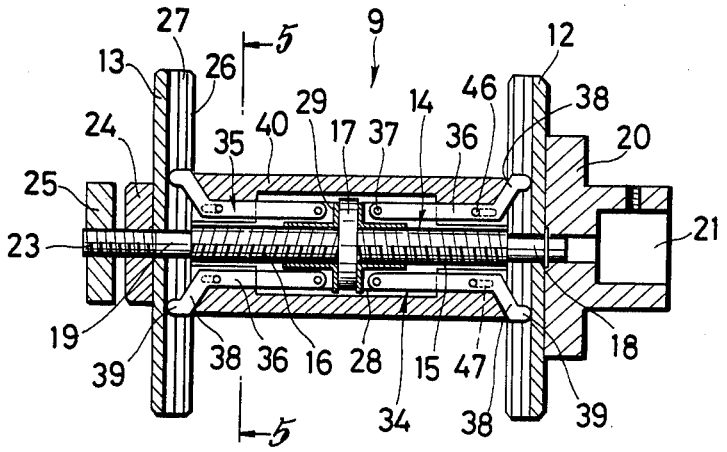
FIG. 3 is a longitudinal cross section view of the yarn feeder.
Figure 4:
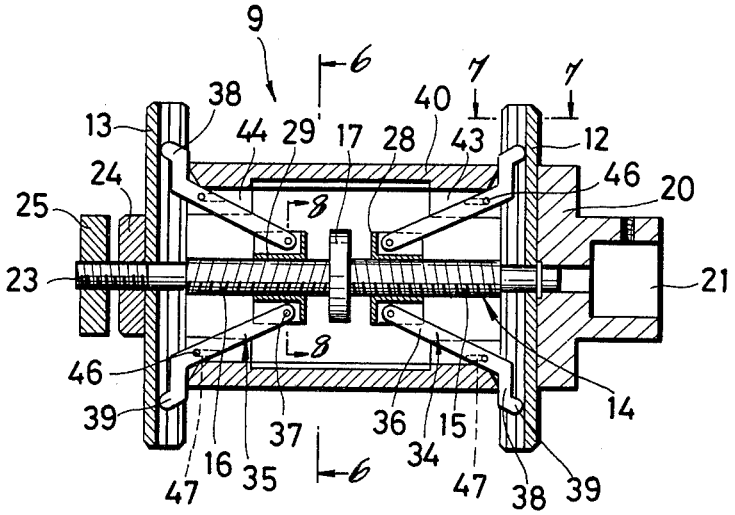
FIG. 4 is a view similar to FIG. 3, showing yarn bars displaced radially outwardly.

As best shown in FIGS. 2 through 4, the weft yarn feeder 9 comprises a pair of spaced circular plates 12, 13 lying substantially parallel to each other, and a spindle 14 rotatably supported on an extending centrally axially through the circular plates 12, 13. The spindle 14 has a pair of externally threaded portions 15, 16 of opposite thread directions. A stop disc 17 is fixedly mounted on the spindle 14 at a position between the threaded portions 15, 16. The spindle 14 has a pair of smaller-diameter journals 18, 19 rotatable in the circular plates 12,13.

An attachment block 20 is mounted on the circular plate 12 and has an axial recess 21 for lockingly receiving a drive shaft 22 (FIG. 1) that is rotatable about its own axis at a constant rate of speed.

The spindle 14 has an externally threaded end portion 23 projecting beyond the circular plate 13. A fastening nut 24 is threaded over the threaded end portion 23. A peripherally knurled knob 25 is fixed to the threaded end portion 23. The spindle 14 can be turned about its own axis by turning the knob 25, for example manually and can be nonrotatably held in place relatively to the circular plate 13 by tightening the fastening nut 24 against the circular plate 13.

Figure 5:
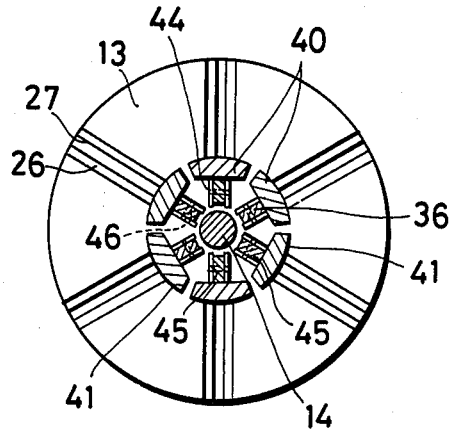
FIG. 5 is a cross section view taken along section line 5—5 of FIG. 3.
Figure 7:
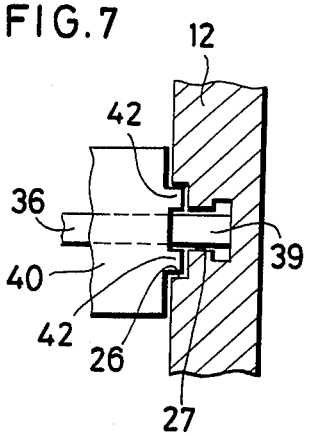
FIG. 7 is a cross section view, at an enlarged scale, taken along section line 7—7 of FIG. 4.
Figure 6:
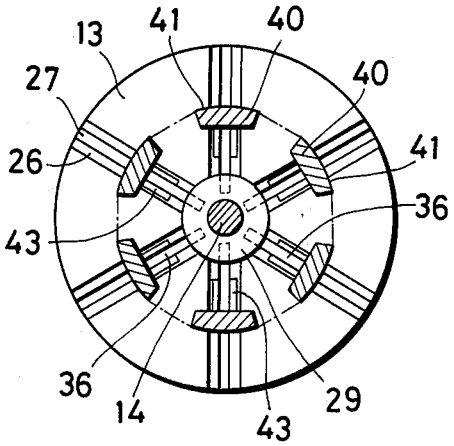
FIG. 6 is a cross section view taken along section line 6—6 of FIG. 4.

Each of the circular plates 12, 13 has a plurality of guide slots 26 which, as best shown in FIGS. 5 and 6, extend radially of the spindle 14 and are angularly spaced equal distances from each other, the guide slots 26 being substantially straight. In FIG. 7, each of the guide slots 26 includes a groove 27 located centrally of the slot 26 and being narrower than the opening of the guide slot 26.

Figure 8:
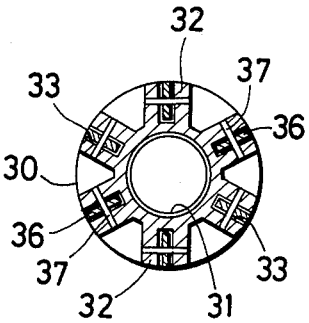
FIG. 8 is a cross section view, at an enlarged scale, taken along section line 8—8 of FIG. 4.

A pair of threaded carriages 28, 29 are carried on the threaded portions 15, 16 respectively of the spindle 14. Each of the carriages 28, 29 comprises a tubular member 30 (FIG. 8) having an internally threaded portion 31 threadedly engaging one of the externally threaded portions 15, 16 of the spindle 14. The tubular member 30 includes a plurality of radial supports 32 angularly spaced equal distances from each other. Each of the radial supports 32 has a groove or channel 33 opening radially outwardly of the tubular member 30.

A pair of link means 34, 35 are pivotally connected to the carriages 28, 29, respectively. Each of the link means 34, 35 comprises a plurality of links 36 disposed around the spindle 14 and angularly spaced equal distances from each other. Each link 36 has one end disposed in one of the grooves 33 and pivotally connected to the support 32 by means of a pin 37 extending through said one end of the link 36 across the groove 33, as better illustrated in FIG. 8.

Each of the links 36 has a radially outwardly bent portion 38 having a distal end 39 remote from the pivoted end, slidably disposed in the groove 27 (FIG. 7).

A plurality of yarn bars 40 extend axially along and are disposed radially around the spindle 14 and equidistantly spaced in an angular direction. The yarn bars 40 have a plurality of arcuate surfaces 41 (FIGS. 5 and 6) which jointly provide a substantially cylindrical configuration around which the weft yarn 10 is to be wound. Each yarn bar 40 has end projections 42 (FIG. 7) slidably disposed in the guide slot 26.

Each of the yarn bars 40 has a pair of radial supports 43, 44 at its end portions, projecting radially inwardly toward the spindle 14. Each radial support 43, 44 includes a groove or channel 45 extending longitudinally of the yarn bar 40 and receiving a portion of one of the links 36. The link 36 has a pin 46 extending across the groove 45 through a slot 47 formed in the radial support 43, 44 and extending in the longitudinal direction of the yarn bar 40. The links 36 and the yarn bars 40 are pivotally loosely connected so that the pins 46 can move relatively to the radial support 43 of the yarn bars 40 during the radial movement of the yarn bars 40.

When it is necessary to change the rate of feed of the weft yarn 10, the knob 25 is rotated to turn the spindle 14. The carriages 28, 29 are moved simultaneously longitudinally on the spindle 14 toward or away from each other, whereupon the links 36 are caused to pivot on the pins 37 on the carriages 28, 29. The ends 39 of the links 36 are simultaneously slid along the grooves 27 radially outwardly or inwardly, thereby enabling the yarn bars 40 to be displaced radially outwardly away from or inwardly toward the spindle 14 (FIGS. 3 and 4) and parallel thereto. Accordingly, the diameter of the cylinder-like configuration defined jointly by the yarn bars 40 and around which the weft yarn 10 is to be wound is changed to provide a different rate of feed of the weft yarn 10 while the weft yarn feeder 9 is being rotated at the same speed.

Since the yarn bars 40 are supported and driven at both ends, they move smoothly and uniformly in a radial direction in response to the rotation of the spindle 14. Such radial movement of the yarn bars 40 can be effected gradually with fine adjustment by the rotation of the knob 25.

Although a preferred embodiment has been shown and described in detail, it should be understood that various changes and modifications can be made therein without departing from the scope of the appended claims.

What is claimed is:

1. A yarn feeder comprising:

(a) a pair of spaced plates substantially parallel to each other;

(b) a single spindle between said plates rotatably supported on said plates and including a pair of externally threaded portions having opposite thread directions, each of said plates having a plurality of guide slots extending radially of said spindle and angularly spaced from each other, the guide slots in said plates being arranged in axially aligned pairs;

(c) a pair of threaded carriages carried on said spindle having respective threads engaging a corresponding one of said pair of threaded portions, respectively, and simultaneously movable toward and away from each other in response to rotation of said spindle;

(d) a plurality of bars extending axially along and disposed radially around said spindle equidistantly spaced in a circumferential direction, each of said bars having a pair of end portions slidably received respectively in the guide slots in a corresponding one of said axially aligned pairs; and (e) a pair of link means each operatively connected between one of said carriages and said bars for moving said bars longitudinally parallel to said spindle and radially outwardly from and inwardly toward said spindle in response to rotation of said spindle.

2. A yarn feeder according to claim 1, in which each of said guide slots is substantially straight.

3. A yarn feeder according to claim 1, in which each of said carriages comprises a tubular member having an internally threaded portion threaded on one of said threaded portions of said spindle.

4. A yarn feeder according to claim 1, in which each of said carriages has a plurality of supports angularly spaced from each other, each of said link means comprising a plurality of links having respective first ends pivotally connected to said supports and respective second ends pivotally connected to a corresponding one of said bars.

5. A yarn feeder according to claim 4, in which said supports having a plurality of grooves, respectively, each of said first ends of the links are disposed in one of said grooves, and a plurality of pins, respectively, extending through said first ends of the links across said grooves.

6. A yarn feeder according to claim 1, in which each of said bars has a pair of supports at its end portions, each of said link means comprising a plurality of links having respective first ends pivotally connected to one of said carriages and having portions pivotally loosely connected to said supports.

7. A yarn feeder according to claim 6, in which said supports have a plurality of grooves, respectively, each of said respective first ends of the links being disposed in a respective one of said grooves, and a plurality of pins, respectively, extending through said first ends of the links across said grooves.

8. A yarn feeder according to claim 7, in which said supports have a plurality of slots, respectively, extending in the longitudinal direction of said bars, said pins extending loosely through said slots, respectively.

9. A yarn feeder according to claim 1, in which each of said link means comprises a plurality of links pivotally connected between one of said carriages and said bars, said guide slots including a plurality of grooves, respectively, and each of said links having one end slidably disposed in one of said grooves.

10. A yarn feeder comprising:

(a) a pair of spaced plates substantially parallel to each other;

(b) a spindle between said plates rotatably supported on said plates and including a pair of externally threaded portions having opposite thread directions, each of said plates having a plurality of guide slots extending radially of said spindle and angularly spaced from each other, the guide slots in said plates being arranged in axially aligned pairs;

(c) a pair of threaded carriages cooperative with said spindle having respective threads cooperative with said pair of threaded portions, respectively, and movable toward and away from each other in an axial direction of said spindle in response to rotation of said spindle;

(d) a plurality of bars extending axially along and disposed radially around said spindle, each of said bars having a pair of end portions slidably received respectively in the guide slots in one of said axially aligned pairs each of said bars having a pair of supports at its end portions;

(e) a pair of link means each operatively connected between one of said carriages and said bars for moving said bars radially outwardly from and inwardly to said spindle in response to rotation of said spindle, and each of said link means having respective first ends pivotally connected to one of said carriages and having portions loosely connected to said supports.

11. A yarn feeder comprising:

(a) a pair of spaced plates substantially parallel to each other;

(b) a spindle between said plates rotatably supported on said plates and including a pair of threaded portions having opposite thread directions, each of said plates having a plurality of guide slots extending radially of said spindle and angularly spaced from each other, the guide slots in said plates being arranged in axially aligned pairs on the two plates;

(c) a pair of threaded carriages respectively driven by said threaded portions, and movable toward and away from each other in an axial direction of the spindle in response to rotation of said spindle;

(d) a plurality of bars extending axially of said spindle and disposed radially around said spindle, each of said bars having a pair of end portions slidably received respectively in the guide slots in one of said axially aligned pairs, each of said bars having a pair of supports at its end portions, said supports having a plurality of grooves;

(e) a pair of link means each operatively connected between one of said carriages and said bars for moving said bars radially outwardly from and inwardly to said spindle in response to rotation of said spindle, each of said link means comprising a plurality of links having respective first ends pivotally connected to one of said carriages and having portions loosely connected to said supports, each of said first ends of the links being disposed in a respective one of said grounds, and a plurality of pins respectively extending through said first ends of the links across said grooves.

12. A yarn feeder according to claim 11, in which said supports have a plurality of slots, respectively, extending in the longitudinal direction of said bars, said pins extending loosely through said slots, respectively.

13. A yarn feeder comprising:

(a) a pair of spaced plates substantially parallel to each other;

(b) a spindle rotatably supported on said plates and including a pair of threaded portions having opposite thread directions, each of said plates having a plurality of guide slots extending radially of said spindle and angularly spaced from each other, the guide slots in said plates being arranged in axially aligned pairs on the two plates;

(c) a pair of threaded carriages respectively coactive with threads of a corresponding one of said pair of threaded portions, and movable toward and away from each other in response to rotation of said spindle;

(d) a plurality of bars extending axially along and disposed radially around said spindle, each of said bars having a pair of end portions slidably received respectively in the guide slots in one of said axially aligned pairs;

(e) a pair of link means each operatively connected between one of said carriages and said bars for moving said bars radially outwardly from and inwardly to said spindle in response to rotation of said spindle, each of said link means comprising a plurality of links pivotally connected between one of said carriages and said bars, said guide slots including a plurality of grooves respectively, and each of said links having one end slidably disposed in one of said grooves.

* * * * *